US005315355A

United States Patent [19]

Johnson

[11] Patent Number: 5,315,355

[45] Date of Patent: May 24, 1994

[54] TRANSFER DRUM WITH SHIM MEMBER TO REDUCE SYSTEM VELOCITY FLUCTUATIONS

[75] Inventor: Kevin M. Johnson, Rochester, N.Y.

[73] Assignee: Eastman Kodak Company, Rochester, N.Y.

[21] Appl. No.: 956,129

[22] Filed: Oct. 5, 1992

[51] Int. Cl.[5] ..... G03G 15/14

[52] U.S. Cl. ..... 355/277; 355/279

[58] Field of Search ..... 355/271, 272, 274, 277, 355/279, 326, 327; 271/275, 276; 346/157, 138, 132; 400/525, 527, 527.2, 662

[56] References Cited

U.S. PATENT DOCUMENTS

| | | | |
|---|---|---|---|
| 1,735,870 | 11/1929 | Kurowski | 400/527 X |
| 4,106,868 | 8/1978 | Ophey | 355/277 |
| 4,257,700 | 3/1981 | Tsuda et al. | 355/272 |
| 4,326,792 | 4/1982 | Landa | 355/271 |
| 4,796,047 | 1/1989 | Fowlkes et al. | 355/277 |
| 4,849,795 | 7/1989 | Spehrley, Jr. et al. | 355/271 X |
| 4,862,214 | 8/1989 | Kasahara et al. | 355/277 |
| 4,864,358 | 9/1989 | Kasahara | 355/277 |
| 4,872,037 | 10/1989 | Kasahara et al. | 355/271 |
| 4,875,069 | 10/1989 | Takada et al. | 355/271 |
| 5,016,056 | 5/1991 | Johnson et al. | 355/279 |
| 5,041,877 | 8/1991 | Matsumoto | 355/271 |
| 5,150,164 | 9/1992 | Shea | 355/271 |

FOREIGN PATENT DOCUMENTS

| | | | |
|---|---|---|---|
| 0015663 | 1/1985 | Japan | 355/274 |
| 0075773 | 4/1988 | Japan | 355/274 |
| 0156278 | 6/1990 | Japan | 355/274 |
| 0162350 | 6/1990 | Japan | 355/279 |

*Primary Examiner*—A. T. Grimley
*Assistant Examiner*—Robert Beatty
*Attorney, Agent, or Firm*—Leonard W. Treash, Jr.

[57] ABSTRACT

An imaging system includes an imaging member having an imaging surface on which transferable images are formed. Preferably the imaging member is a photoconductive drum. The system further includes a transfer drum having an outer surface adapted to receive and retain an image-receiver sheet having lead and trail edges. A shim member, preferably thinner than the image-receiver sheet, is positioned on the peripheral surface of the transfer drum adjacent the lead and/or trail edges of a retained image-receiver sheet. The shim member acts to reduce system velocity fluctuations which occur as the lead and trail edges of the image-receiver sheet, respectively, enter and leave a nip formed by the transfer drum and the imaging member.

10 Claims, 4 Drawing Sheets

TRANSFER DRUM WITH SHIM MEMBER TO REDUCE SYSTEM VELOCITY FLUCTUATIONS

TECHNICAL FIELD OF THE INVENTION

The present invention relates generally to imaging systems and, more particularly, to imaging systems which use heat and pressure to transfer an image from an image forming surface to an image-receiver sheet.

BACKGROUND ART

In printer systems wherein an intensity-modulated beam of radiation (e.g., a laser beam) repeatedly scans a moving recording element to record image information, pixel-by-pixel, the velocity at which the recording element moves must be extremely uniform to produce high quality images. This also applies where the image information is being applied to a moving recording element line-by-line, such as with a linear array of light emitting diodes, or page-by-page as with an optical copier. If the velocity at which the recording element moves varies while the rate at which the image information is conveyed remains the same, there will be either a crowding together or spreading apart of lines of image information. This artifact, known as banding, causes a degradation in image quality.

In commonly assigned U.S. Pat. No. 5,140,370, issued Aug. 18, 1992 in the name of Kevin M. Johnson, entitled POSITION CONTROL FOR TRANSFER DRUM IN ELECTROSTATOGRAPHIC PRINTER/-COPIER, there is disclosed an electrophotographic apparatus in which a scanning laser beam imagewise discharges an electrostatic charge on the surface of a photoconductive drum, leaving an electrostatic latent image. The electrostatic latent image is developed with colored toner particles from one of several development stations to create a transferable color toner image on the outer surface of the photoconductive drum. The toner image is transferred to an image-receiver sheet at a nip formed between the photoconductive drum and a transfer drum. The transfer drum is internally heated and its outer surface is urged into contact with the photoconductive drum surface at a relatively high force (e.g., 300–500 pounds).

When the leading edge of the image-receiver sheet enters the nip, it suddenly retards the rotation of the photoconductive drum, causing a sudden increase in the torque (force) required to rotate the drum at constant speed. Similarly, when the trailing edge of the image-receiver sheet leaves the nip, the drum torque is suddenly decreased, causing a temporary increase in drum speed. If the laser is recording image information at the time of these "torque spikes", variations in line spacing will occur, causing the above-described banding artifact to appear.

The above-mentioned velocity fluctuations have a particularly adverse impact on the quality of prints produced by multicolor printer systems. In the Johnson apparatus, several color separation toner images are superimposed on each other on the image-receiver sheet to form a multicolor image. If the lines of image information are not uniformly spaced apart for each color separation image, color misregistration will result in the composite image.

SUMMARY OF THE INVENTION

In view of the foregoing discussion, an object of this invention is to provide an improved transfer drum which includes a shim member to minimize imaging system velocity fluctuations.

The present invention relates to a rotatably-driven transfer drum which includes a peripheral surface adapted to receive and retain an image-receiver sheet having lead and trail edges. A shim member is positioned on and supported by the peripheral surface adjacent one of the lead or trail edges of a retained image-receiver sheet. The shim member being about the same thickness as the retained image-receiver sheet.

In a refinement of the invention, a second shim member is positioned on the peripheral surface adjacent one of the lead or trail edges of the retained image-receiver sheet which does not have the shim member adjacent to it. Preferably, the shim member and the second shim member form one unitary shim member, and this unitary shim member is thinner than the retained image-receiver sheet by an amount about equivalent to an amount the image-receiver sheet is compressed during image transfer. Preferably, the unitary shim member is slightly skewed relative to a line on the peripheral surface which is parallel to an axis of rotation of the transfer drum.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Although the invention is being described hereinbelow with particular reference to an electrophotographic recording system in which a laser scanner is used to imagewise expose a photoconductive recording element, it will be apparent to those skilled in the art that the invention has utility in any high quality imaging system in which images are produced on a pixel-by-pixel, line-by-line (such as with an array of LED's or thermal emitters) or page-by-page basis on a moving recording element.

Figure 1:
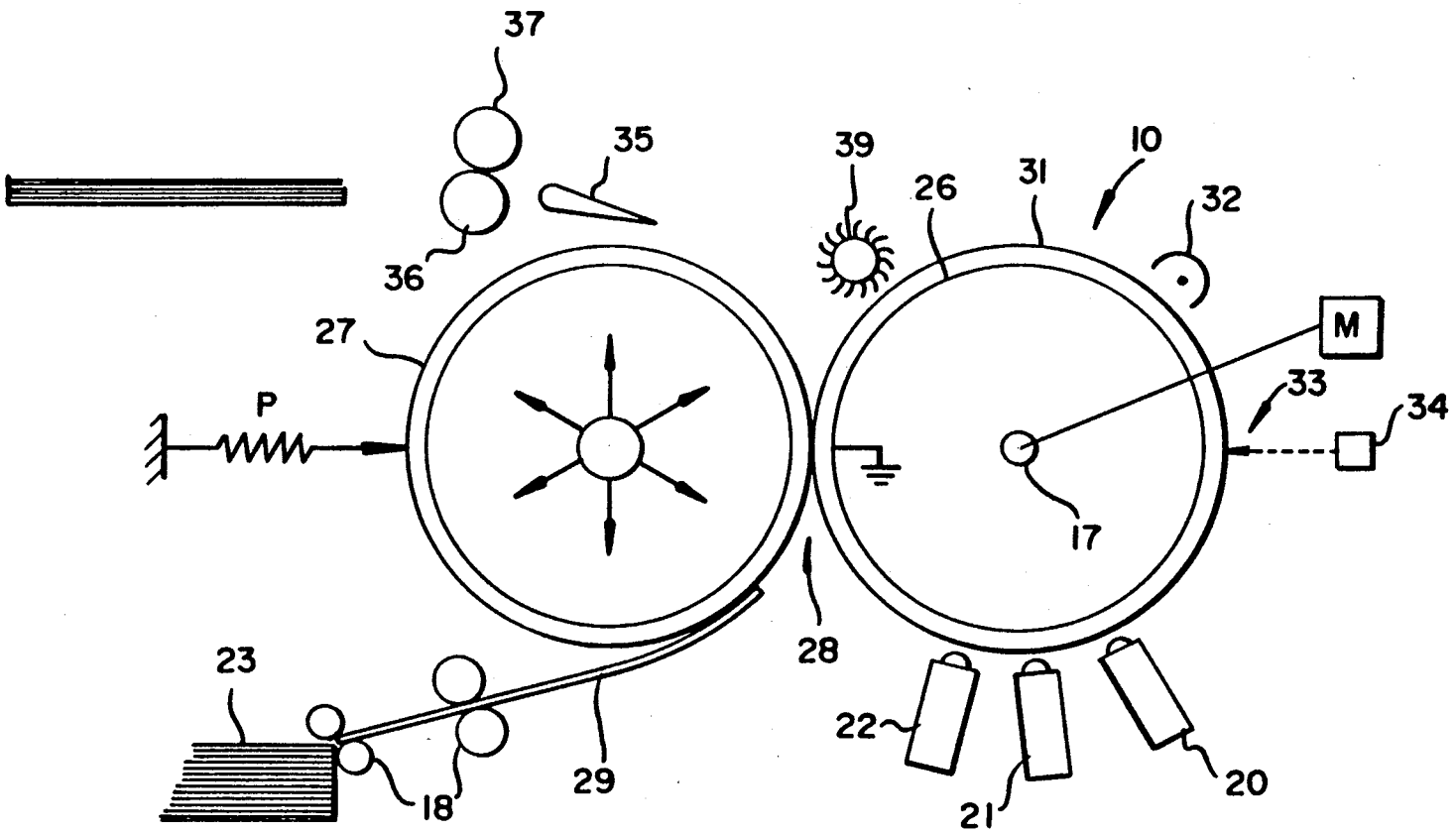
FIG. 1 is a schematic illustration of an electrophotographic color printer in which the invention has utility.

Turning now to FIG. 1, a multicolor electrophotographic imaging system is disclosed in which transferable toner images of different color are formed on an imaging surface of an imaging member such as photoconductive drum 10. Drum 10 comprises an electrically conductive cylinder 26 which includes a photoconductive layer 31. The photoconductive drum is rotatably supported by a frame (not shown) and is driven at a uniform velocity by a motor M which is coupled to an axle 17 of cylinder 26. The recording apparatus includes a charger 32 for depositing a uniform electric charge on an imaging surface of photoconductive layer 31. Layer 31 is then imagewise exposed according to color separation image data by a laser beam scanning apparatus comprising a laser beam source 34 which produces an intensity-modulated laser beam 33. A rotating polygon or the like (not shown) serves to repeatedly scan the beam in a direction normal to the plane of the drawing, thereby producing a series of horizontal scan lines, while the vertical or cross-scanning of the beam is achieved by rotation of the drum, thus generating a two-dimensional raster scan. This scanning selectively discharges the photoconductive layer, leaving behind a latent electrostatic image.

Next, the latent electrostatic image on photoconductive layer 31 is developed by one of the three developer stations 20, 21 or 22 to form a transferable image. (In a monochrome system there would be only one developer station.) As is well known in the art, toner particles of a charge opposite that of the electrostatic latent image are brought into proximity with the outer layer 31. The toner particles adhere to the outer layer in a pattern corresponding to the electrostatic latent image.

An image-receiver sheet 29, such as a sheet of paper or a transparency, is then fed from a stack 23 by two pairs of feed rollers 18 onto the peripheral surface of a transfer drum 27 which is rotatably driven by the photoconductive drum. Image-receiver sheet 29 is retained on transfer drum 27 by, for example, a vacuum applied through small holes in the surface of the transfer drum. The developed image on the photoconductive drum is transferred to image-receiver sheet 29 at a transfer zone 28 defined by the nip between the two drums. The transfer drum is internally heated by a heating element E which will heat the peripheral surface of the transfer drum to preferably about 110 degrees centigrade. Pressure-applying means P are provided for urging the peripheral surface of the transfer drum into engagement with the photoconductive drum at a force of preferably about 300–500 pounds. Thus, transfer of the toner image from the photoconductive drum to the image-receiver sheet is effected by a combination of heat and pressure.

If the final copy is to be a multicolor copy, image-receiver sheet 29 remains on transfer drum 27 for several revolutions, and the foregoing image-forming process is repeated. During each subsequent process, however, the image information imparted by light beam 33 will correspond to a different color separation image than during the previous passes. A different development station 20, 21 or 22 containing a different colored toner will be used to develop a second color separation image that will be superimposed on the first color separation image on image-receiver sheet 29. The process continues until all colors have been superimposed onto image-receiver sheet 29.

After the image-receiver sheet has received the entire image from the photoconductive drum, a pick-off blade 35 removes the image-receiver sheet from the surface of transfer drum 27. Image-receiver sheet 29 then passes through a nip formed by a fusing roller 37 and a backing roller 36. Fusing roller 37 is maintained at an elevated temperature and permanently fuses the toned image to the image-receiver sheet 29. Cleaning brush 39 cleans the photoconductive drum of any residual toner particles after each image is transferred to image-receiver sheet 29.

Figure 2:
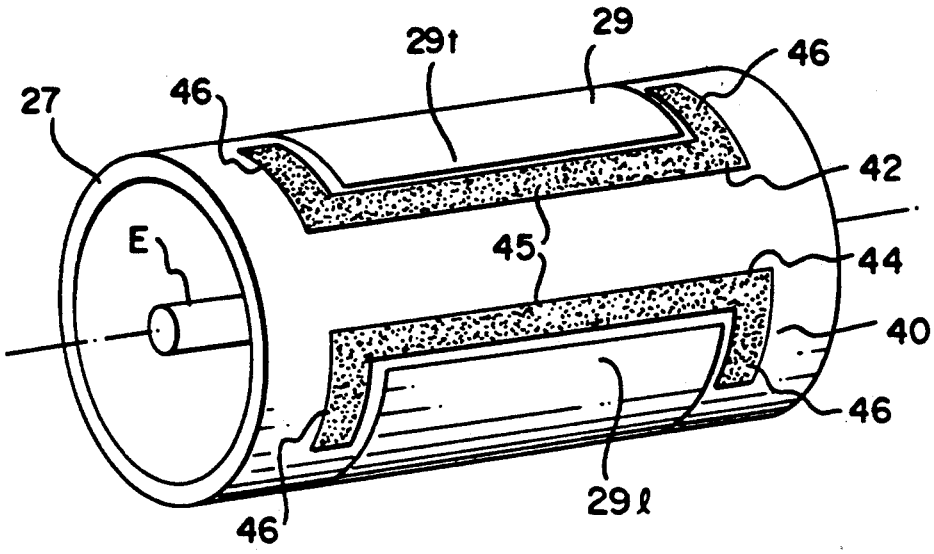
FIG. 2 is a perspective view of a transfer drum with shim members on the peripheral surface of the drum.

Now, in accordance with the present invention, there is provided a novel transfer drum which significantly reduces velocity fluctuations in an imaging system. Referring to FIG. 2, transfer drum 27 has a peripheral surface 40 which includes the previously mentioned vacuum wholes (not shown) through which a vacuum is applied to retain the image-receiver sheet. A shim member 42, located on the peripheral surface of transfer drum 27 is positioned adjacent a trailing edge 29t of the image receiver sheet. A second shim member 44 is positioned adjacent a leading edge 291 of the image-receiver sheet. Shims 42 and 44 are secured to the peripheral surface by, for example, a heat-setting adhesive and are made of a material such as metal or heat-resistant plastic.

Shims 42 and 44 prevent the photoconductive drum from contacting the transfer drum. Unlike other methods of spacing drums apart, shims undergo very little thermal expansion with rising temperatures and are insensitive to the dimensional tolerances of the transfer drum. Further, it is much simpler and less expensive to maintain dimensional tolerances on shims than it is on drums.

Portions 46 of both shims extends along the sides of image-receiver sheet 29. This eliminates having to butt the lead and trail edges of the image-receiver sheet up against the shims. The minimum requirement of portions 46 is that they extend at least to a line that is collinear with the lead or trail edge of the image-receiver sheet. As shown in FIG. 2, portions 46 of each shim member extend well beyond such a line. This allows different size image-receiver sheets to be used on the transfer drum. Preferably, portions 46 extend no further than lines collinear with the lead and trail edges of the smallest image-receiver sheet used on the transfer drum.

Figure 3:
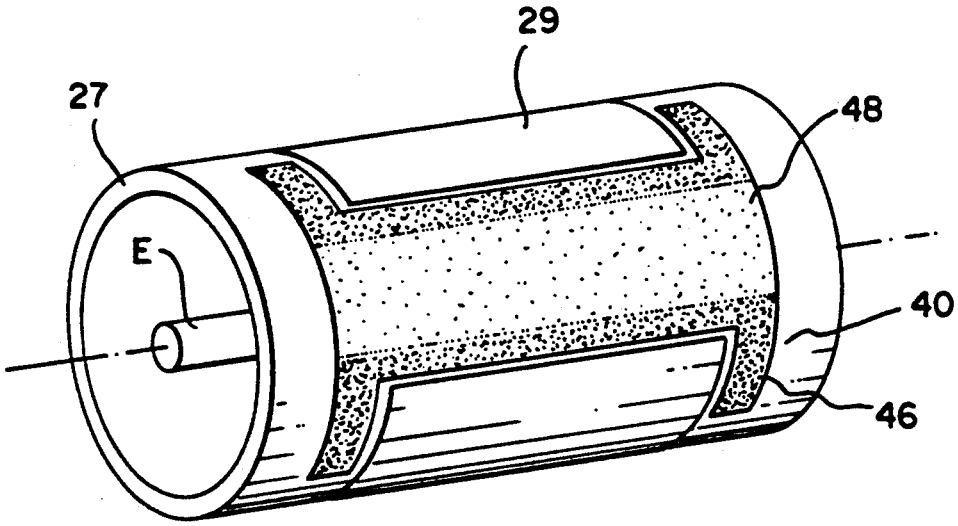
FIG. 3 is a perspective view of a transfer drum with a unitary shim member on the peripheral surface of the drum.

Referring to FIG. 3, another embodiment of the present invention is disclosed. In this embodiment, the shim member and second shim member of FIG. 2 form one unitary shim member 48. Shim member 48 will prevent photoconductive drum 10 from moving towards or away from transfer drum 27 while the photoconductive drum contacts shim member 48 in between the lead and trail edges of image-receiver sheet 29.

Figure 4:
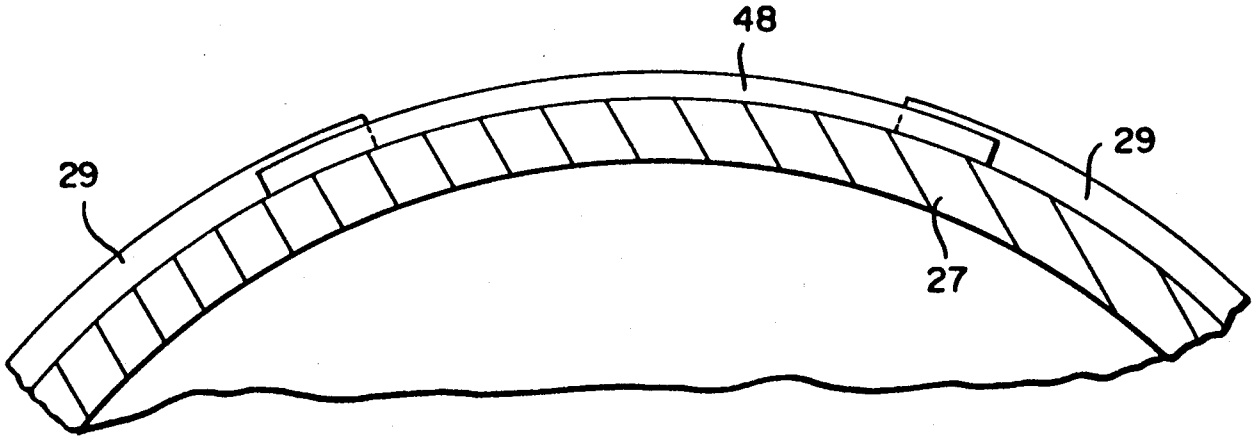
FIG. 4 is a partial sectional view of FIG. 3 taken along the axis of rotation of the transfer drum.

FIG. 4 represents a sectional view of transfer drum 27 taken along the axis of rotation of the transfer drum. When transfer drum 27 is at its operating temperature (e.g. 110 C) shim member 48 is preferably thinner than image-receiver sheet 29 by an amount equal to the compression the image-receiver sheet undergoes during image transfer. For example, if the image receiver sheet is 0.010" thick and it normally compresses 0.0005" during image transfer, then shim member 48 should be about 0.0095" thick. Thus, at the locations where photoconductive drum 10 rolls on and off image-receiver sheet 29, the image-receiver sheet should be the same thickness as shim member 48, ensuring a smooth transition on and off the image-receiver sheet.

Figure 5:
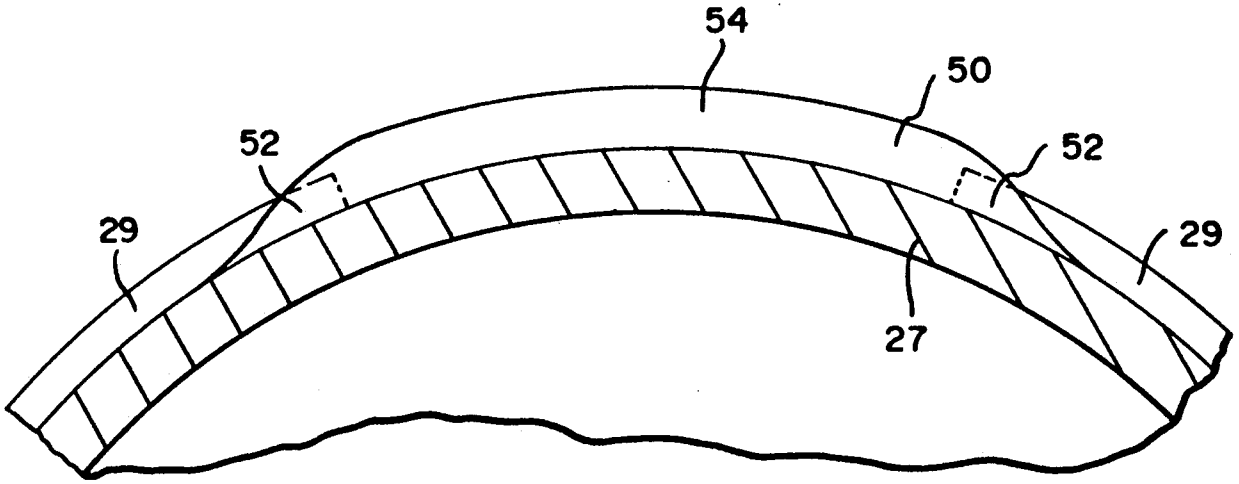
FIG. 5 is a partial sectional view of a transfer drum, taken along the axis of rotation of the transfer drum, which includes a shim member having a different cross-sectional shape than the shim member of FIG. 4.

FIG. 5 is also a sectional view of the transfer drum, taken along the transfer drum's axis of rotation, with a shim member 50 having different cross-sectional characteristics than shim member 48. In this embodiment a center portion 54 of shim member 50 is preferably thicker than image-receiver sheet 29. Center portion 54 is tapered to edges 52, on which photoconductive drum 10 first and last contacts shim member 50, which are thinner than image receiver sheet 29. Preferably, shim member 50 has a similar compliance to image-receiver sheet 29. This tapering of shim member 50 allows photoconductive drum 10 to roll smoothly on and off shim member 50 with minimal jarring to the system. With reference to FIG. 2, in this embodiment edges 45 on shims 42 and 44 would also be tapered.

Figure 6:
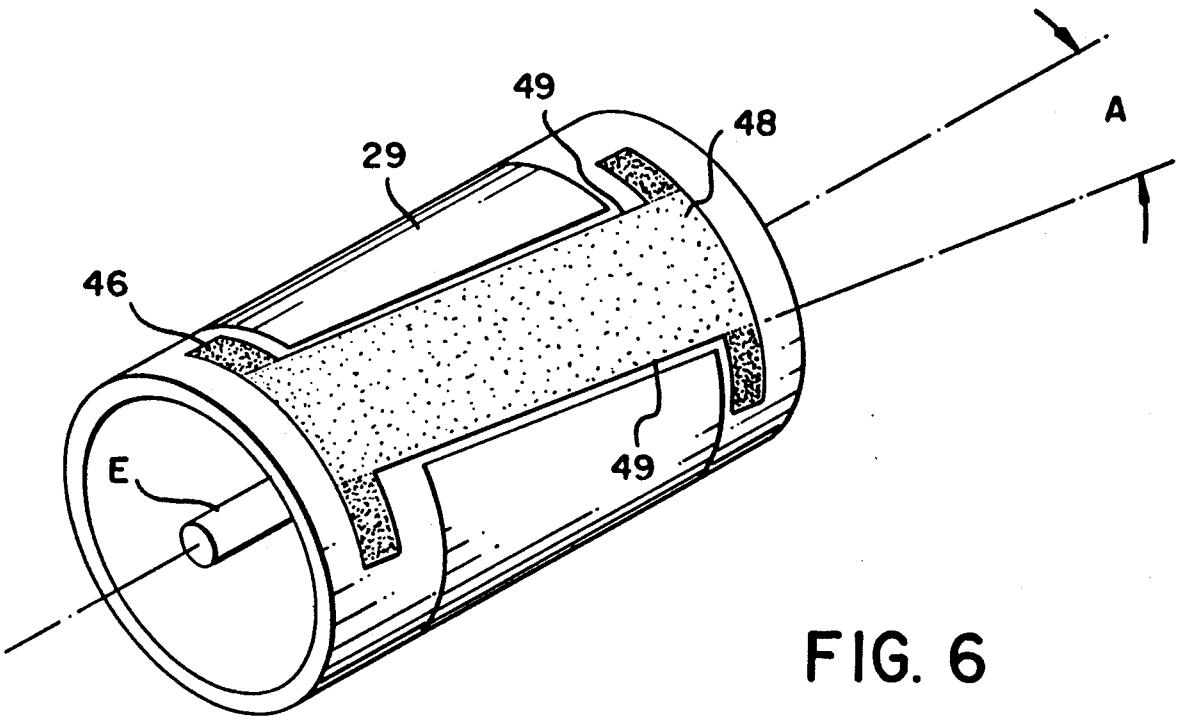
FIG. 6 is a perspective view of a transfer drum with a unitary shim member located in a skewed position on the peripheral surface of the drum.

With reference to FIG. 6, a further embodiment of the present invention is represented. In this embodiment shim member 48 and image-receiver sheet 29 are in a skewed position. That is, the image-receiver sheet is fed onto the peripheral surface such that its leading and trailing edges are essentially parallel with edges 49 of shim member 48. Edges 49 are positioned at an angle A with respect to a line on the peripheral surface of transfer drum 27 which is parallel with the axis of rotation of the transfer drum. Preferably, angle A is between about 1 and 10 degrees. By positioning image-receiver sheet 29 in a slightly skewed position the leading and trailing edges of the image-receiver sheet do not respectively enter and leave the nip between the transfer and photoconductive drums all at once. A corner of the leading edge will first enter the nip with the rest of the leading edge successively entering the nip. This arrangement of the image-receiver sheet assists in minimizing the jarring which occurs when the image-receiver sheet enters and exits the nip.

With the receiver sheet skewed, the image information transferred to the receiver sheet will be skewed relative to the receiver sheet. This problem can be resolved by using an oversized receiver sheet and then trimming the sides and edges of the receiver sheet such that the image information is properly aligned on the trimmed receiver sheet. Another solution to this problem is to use a receiver sheet having end edges which will be parallel with edges 49 of shim 48 when the side edges of this receiver sheet are perpendicular to a line on the surface of the transfer drum which is parallel with the transfer drum's axis of rotation. In other words, the end edges of the receiver sheet are not perpendicular with the side edges of the receiver sheet by preferably 1–10 degrees. When the image information is transferred to the receiver sheet it will be aligned with the receiver sheet's side edges but not its end edges. The end edges are then trimmed to align the image information with the trimmed end edges.

Another way to align image information on a skewed receiver sheet is to create the image of the original in a skewed manner. In a system using a laser or LED printhead to discharge the photoconductor, this skewing of the image information can be accomplished by altering the way in which the data is fed to the laser or LED printhead. In an optical copier, this skewing of the image information can be accomplished by, for example, off-setting the original on a platen with a skewed edge guide. In this manner, images formed on photoconductive drum 10 will be properly aligned on image-receiver sheet 29 when transferred to the image-receiver sheet.

The shim(s) of the present invention prevents the photoconductive drum from (1)impacting the leading edge of an image-receiver sheet and (2) impacting the transfer drum when it rolls off the trailing edge of the image-receiver sheet. By minimizing these jarring impacts, system velocity fluctuations are greatly reduced and image quality is substantially increased.

The invention has been described in detail with particular reference to preferred embodiments thereof, but it will be understood that variations and modifications can be effected within the spirit and scope of the invention.

What is claimed is:

1. An imaging system, comprising:

an imaging member having an imaging surface on which transferable images are formed;

means for forming a transferable image on said imaging surface;

a rotatably driven drum having a peripheral surface adapted to receive and retain an image-receiver sheet having lead and trail edges;

means for urging said peripheral surface of said drum into engagement with said imaging surface to effect transfer of an image on said imaging surface to an image-receiver sheet retained on said peripheral surface, said urging means causing said image-receiver sheet to be compressed in thickness during such image transfer; and a shim member positioned on and supported by said peripheral surface of said drum so as to be adjacent one of a lead or trail edge of a retained image-receiver sheet, said shim member being about the same thickness as said retained image-receiver sheet, at least a portion of said shim member being essentially parallel with said lead or trail edge and at least a portion of said shim member being perpendicular with said lead or trial edge.

2. The imaging system of claim 1, further comprising:

a second shim member positioned adjacent one of the leading or trailing edges of said retained image-receiver sheet which does not have said shim member adjacent to it.

3. The imaging system of claim 2 wherein said shim member and said second shim member form one unitary shim member.

4. The imaging system of claim 1 wherein said shim member is thinner than said image-receiver sheet.

5. The imaging system of claim 4 wherein said shim member is thinner than said image-receiver sheet by an amount about equivalent to an amount said image-receiver sheet is compressed during image transfer.

6. The imaging system of claim 1 wherein edges of said shim member, on which said imaging surface first and last contacts said shim member, are thinner than said image receiver sheet and wherein a center portion of said shim member is thicker than said image-receiver sheet.

7. The imaging system of claim 1 wherein said image-receiver sheet is retained on said peripheral surface slightly skewed relative to a line on said peripheral surface which is parallel to an axis of rotation of said transfer drum, and wherein said shim member is also skewed by about the same amount as said image-receiver sheet.

8. For use in an image forming apparatus having an imaging surface on which transferable toner images are formed and means for forming the transferable toner images on the imaging surface, a transfer drum receiveably by such an image forming apparatus to facilitate transfer of a toner image formed on the imaging surface to an image receiver sheet having lead and trail edges, said transfer drum comprising:

a rotatably driven drum having a peripheral surface adapted to receive and retain the image receiver sheet;

means for urging the transfer drum toward the image member with sufficient force to compress the image receiver sheet; and a shim member positioned on and supported by said peripheral surface at a position adjacent one of the lead or trail edges of a retained image receiver sheet, said shim member being about the same thickness as the image receiver sheet when compressed during image transfer and at least a portion of said shim member being essentially parallel with said lead or trail edge and at least a portion of said shim member being perpendicular with said lead or trail edge.

9. For use in an image forming apparatus having an imaging surface on which transferable toner images are formed and means for forming the transferable toner images on the imaging surface, a transfer drum receivably by such an image formed apparats to facilitate transfer of a toner image formed on the imaging surface to an image receiver sheet having lead and trail edges, said transfer drum comprising:

a rotatably driven drum having a peripheral surface adapted to receive and retain the image receiver sheet;

means for urging the transfer drum toward the image member with sufficient force to compress the image receiver sheet; and a shim member positioned on and supported by said peripheral surface adjacent one of the lead or trail edges of a retained image receiver sheet, said shim member being about the same thickness as the retained image receiver sheet, edges of said shim member on which an imaging surface first and last contact said shim member being thinner than sad image receiver sheet while a center portion of said shim member being thicker than said image receiver sheet and at least a portion of said shim member being essentially parallel with said lead or trail edge and at least a portion of said shim member being perpendicular with said lead or trail edge.

10. For use in an image forming apparatus having an imaging surface on which transferable toner images are formed and means for forming the transferable toner images on the imaging surface, a transfer drum receivable by such an image forming apparatus to facilitate transfer of a toner image formed on the imaging surface to an image receiver sheet having lead and trail edges, said transfer drum comprising:

a rotatably driven drum having a peripheral surface adapted to receive and retain the image receiver sheet;

means for urging the transfer drum toward the image member with sufficient force to compress the image receiver sheet; and a shim member positioned on and supported by said peripheral surface adjacent one of the lead or trail edges of a retained image receiver sheet, said shim member being about the same thickness as the retained image receiver sheet, said shim member being slightly skewed relative to a line on said peripheral surface which is parallel to an axis of rotation of said rotatably driven drum and at least a portion of said shim member being essentially parallel with said lead or trail edge and at least a portion of said shim member being perpendicular with said lead or trail edge.

* * * * *